US008887396B2

(12) United States Patent
Wu et al.

(10) Patent No.: US 8,887,396 B2
(45) Date of Patent: Nov. 18, 2014

(54) MANUFACTURING METHOD OF ROLLER FOR MANUFACTURING PATTERNED RETARDER FILM

(75) Inventors: Lung-Hai Wu, Taoyuan County (TW); Cyun-Tai Hong, New Taipei (TW); Fung-Hsu Wu, Taoyuan County (TW)

(73) Assignee: Benq Materials Corporation, Taoyuan County ( * ) Notice: Subject to any disclaimer, the term of this patent is extended or adjusted under 35 U.S.C. 154(b) by 318 days.

(21) Appl. No.: 13/483,071

(22) Filed: May 30, 2012

(65) Prior Publication Data

US 2013/0014628 A1 Jan. 17, 2013

(30) Foreign Application Priority Data

Jul. 11, 2011 (TW) ..... 100124493 A

(51) Int. Cl.

| | |
|---|---|
| ***B21H 1/14*** | (2006.01) |
| ***B21H 1/18*** | (2006.01) |
| ***B21H 1/22*** | (2006.01) |
| ***B26D 3/08*** | (2006.01) |
| ***B31F 1/07*** | (2006.01) |

(52) U.S. Cl.

CPC ... *B26D 3/08* (2013.01); *B31F 1/07* (2013.01); *B31F 2201/0717* (2013.01); *B31F 2201/0733* (2013.01); *B31F 2201/0756* (2013.01)

USPC ..... 29/895.31; 492/31; 492/30

(58) Field of Classification Search

CPC ..... B31F 2201/0715; B31F 2201/0728; B31F 2201/0717; B31F 2207/0733; B21H 1/14; B21D 22/02; B21D 22/08; B21K 1/02; B23P 9/04; B23P 99/02

USPC ..... 29/895.3, 895.31; 492/30, 31, 36; 101/401.1, 401.2, 401.5

See application file for complete search history.

(56) References Cited

U.S. PATENT DOCUMENTS

| | | | | |
|---|---|---|---|---|
| 2,032,541 | A * | 3/1936 | Losier | 101/401.1 |
| 2,699,720 | A * | 1/1955 | Brooks et al. | 358/3.3 |
| 2,738,730 | A * | 3/1956 | Boyajean | 358/3.29 |
| 3,048,512 | A * | 8/1962 | Nelson | 216/9 |
| 3,069,721 | A * | 12/1962 | Arni et al. | 425/403 |
| 3,214,309 | A * | 10/1965 | Di Leo et al. | 216/9 |
| 4,149,304 | A * | 4/1979 | Brynjegard | 29/895.3 |
| 4,293,990 | A * | 10/1981 | Pollock | 29/895.3 |
| 5,445,588 | A * | 8/1995 | Ishibashi et al. | 492/31 |
| 6,074,192 | A * | 6/2000 | Mikkelsen | 425/327 |
| 7,140,812 | B2 * | 11/2006 | Bryan et al. | 407/119 |
| 7,510,462 | B2 * | 3/2009 | Bryan et al. | 451/48 |
| 7,628,100 | B2 * | 12/2009 | Gardiner et al. | 82/118 |
| 7,669,508 | B2 * | 3/2010 | Gardiner et al. | 82/118 |

(Continued)

*Primary Examiner* — David Bryant
*Assistant Examiner* — Jason L Vaughan
(74) *Attorney, Agent, or Firm* — CKC & Partners Co., Ltd.

(57) ABSTRACT

A method for producing a roller used for manufacturing a retarder film is provided. The method includes providing the roller having a roller surface; providing an embossing tool having an embossing end and embossing the roller surface with the embossing tool. The embossing end has a plurality of first microgroove structures and second microgroove structures. The first and second micro-groove structures are both parallel structures. Each one of the first microgroove structures is symmetric to each one of the second microgroove structures with respect to a symmetry line. An included angle of the symmetry line between each first micro-groove structure and that between each second micro-groove structure are 45±8 degrees.

12 Claims, 7 Drawing Sheets

(56) References Cited

U.S. PATENT DOCUMENTS 7,677,146 B2 * 3/2010 Gardiner et al. ..... 82/70.2
7,852,570 B2 * 12/2010 Gardiner et al. ..... 359/707
8,412,080 B2 * 4/2013 Maeda et al. ..... 399/279
8,510,951 B2 * 8/2013 Lee et al. ..... 29/895.32
2004/0031404 A1 * 2/2004 Dixon ..... 101/3.1

* cited by examiner

MANUFACTURING METHOD OF ROLLER FOR MANUFACTURING PATTERNED RETARDER FILM

RELATED APPLICATIONS

This application claims priority to Taiwan Application Serial Number 100124493, filed Jul. 11, 2011, which is herein incorporated by reference.

BACKGROUND

1. Technical Field

The prevent disclosure relates to a method of making rollers, and more particularly to a method of making rollers for manufacturing retarder films.

2. Description of the Related Art

A retarder film has been applied to a liquid crystal display (LCD) to generate a visual three-dimensional stereo effect. As such, the retarder film is commonly used in some commercial products, like stereoscopic display glasses, stereoscopic display TVs and other display products.

To the display products, it is required to ensure an optical quality of the retarder film by keeping an accuracy of manufacturing process of the retarder film. However, keeping the accuracy of manufacturing process of the retarder film reduces manufacturing speed of the retarder film. There is still a need to provide one tool to manufacture the retarder film in keeping with the accuracy and the manufacturing speed of the retarder film.

SUMMARY

The disclosure is to provide a manufacturing method of a roller for manufacturing retarder films.

According to an aspect of the present disclosure, a method for making a roller used for manufacturing a retarder film is provided. The method comprises the steps of: providing the roller having a roller surface; providing an embossing tool having an engraving end; and engraving the roller surface repeatedly with the embossing tool. The embossing end has a plurality of first micro-groove structures and a plurality of second micro-groove structures; the first micro-groove structures and the second micro-groove structures are structures with parallel micro-grooves; the respective first micro-groove structures is symmetric to the respective second micro-groove structures with respect to a symmetry line, and one end of each of the first micro-groove structures correspondingly connects with one end of each of the second micro-groove structures at the symmetry line; and an included angle between the symmetry line and each of first micro-groove structure, and between the symmetry line and each second micro-groove structure are 45±8 degrees.

According to another aspect of the present disclosure, a method for manufacturing the retarder film with micro-structures is provided. The method for manufacturing the retarder film with a plurality of first micro-groove structures and a plurality of second micro-groove structures comprises the following steps. A roller having a roller surface is provided. A embossing tool having an embossing end is provided. The embossing tool embosses the roller surface repeatedly.

In one embodiment, the embossing process is executed according to the following steps. The roller turns and the embossing tool embosses the roller surface along a rotation direction of the roller. The embossing tool then moves with a predetermined distance along an extending direction of the roller upon the roller turning a circle.

In another embodiment, the embossing process is executed according to following steps. The roller stops to turn and the embossing tool embosses the roller surface along an extending direction of the roller. The embossing tool then moves with a second predetermined distance along an extending direction of the roller after above embossing step. The roller turns with a predetermined angle upon the embossing tool reaching one end of the roller.

The above and other embodiments of the disclosure will become better understood with regard to the following detailed description of the preferred but non-limiting embodiment(s). The following description is made with reference to the accompanying drawings.

DETAILED DESCRIPTION OF THE INVENTION

This specification discloses one or more embodiments that incorporate the features of present disclosure. The disclosed embodiment(s) merely exemplify the disclosure. The scope of the disclosure is not limited to the disclosed embodiment(s). The disclosure is defined by the claims appended hereto.

The embodiment(s) described, and references in the specification to "one embodiment," "an example embodiment," etc., indicate that the embodiment(s) described can include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is understood that it is within the knowledge of one skilled in the art to effect such feature, structure, or characteristic in connection with other embodiments whether or not explicitly described.

First Embodiment

Figure 2:
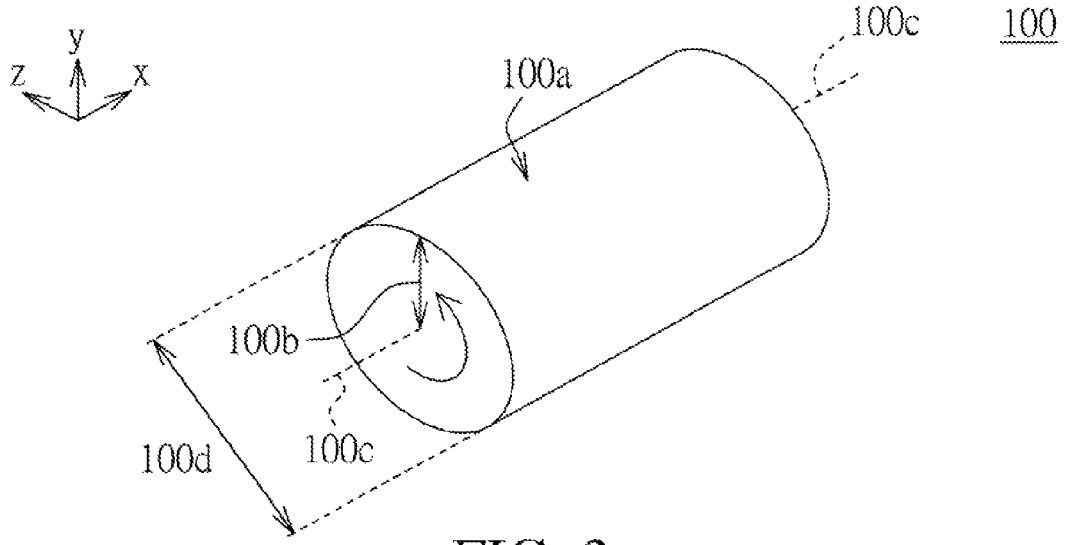
FIG. 2 is a schematic diagram of the roller of FIG. 1.
Figure 6:
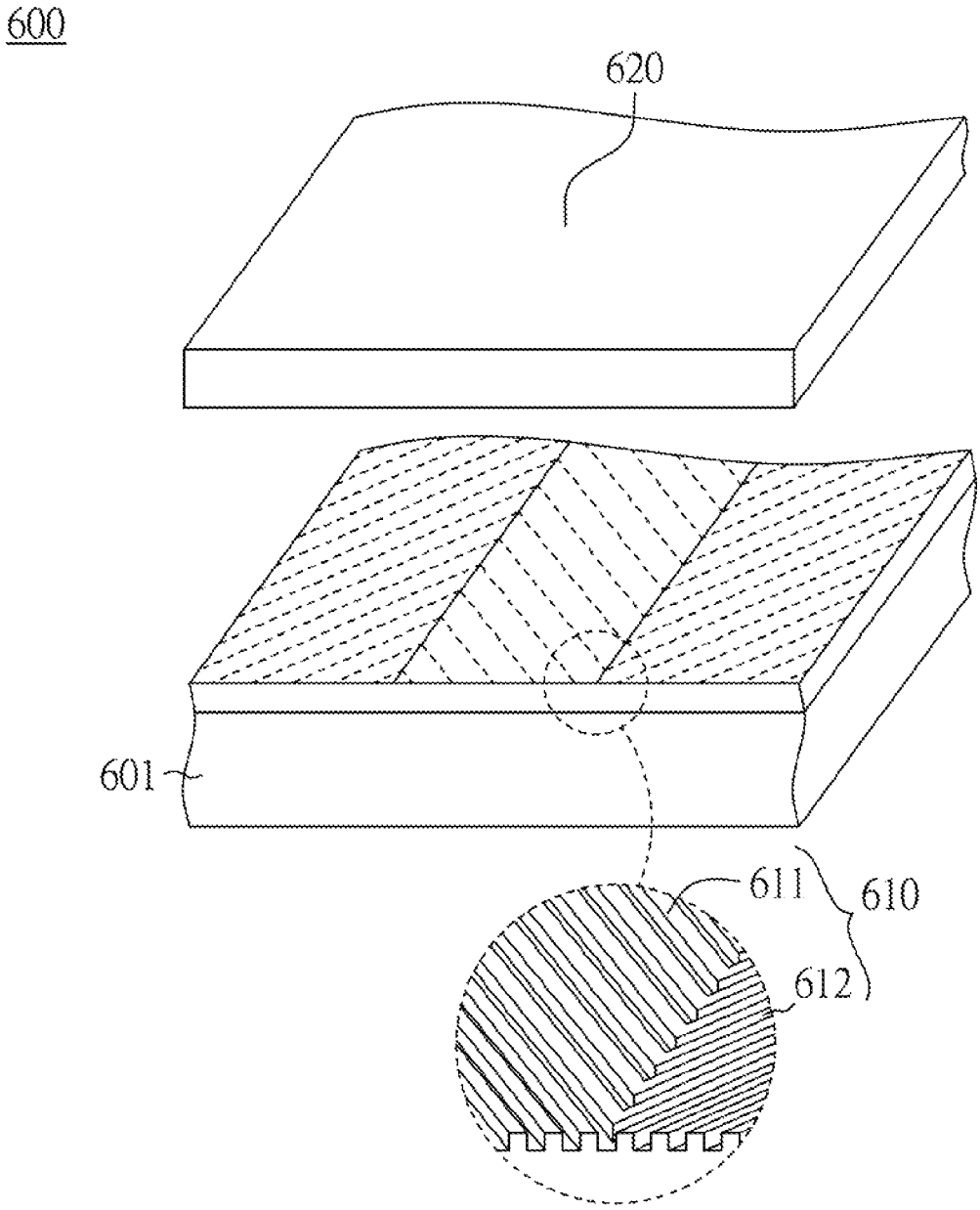
FIG. 6 is a schematic diagram of one embodiment of the retarder film of the present disclosure.

FIG. 2 shows a roller 100 used for manufacturing a retarder film 600 (shown in FIG. 6). The roller 100 includes a rotation axis 100*c* and a roller surface 100*a* having a smooth and cylindrical outer surface. The smooth and cylindrical outer surface means the roller surface 100*a* has a uniform diameter 100*d* along the rotation axis 100*c*. That is, a distance from each point of the roller surface 100*a* to the rotation axis 100*c* is substantially the same. In one embodiment, the roller 100 is made of easily embossing and antioxidant materials, such as copper (Cu).

Figure 3:
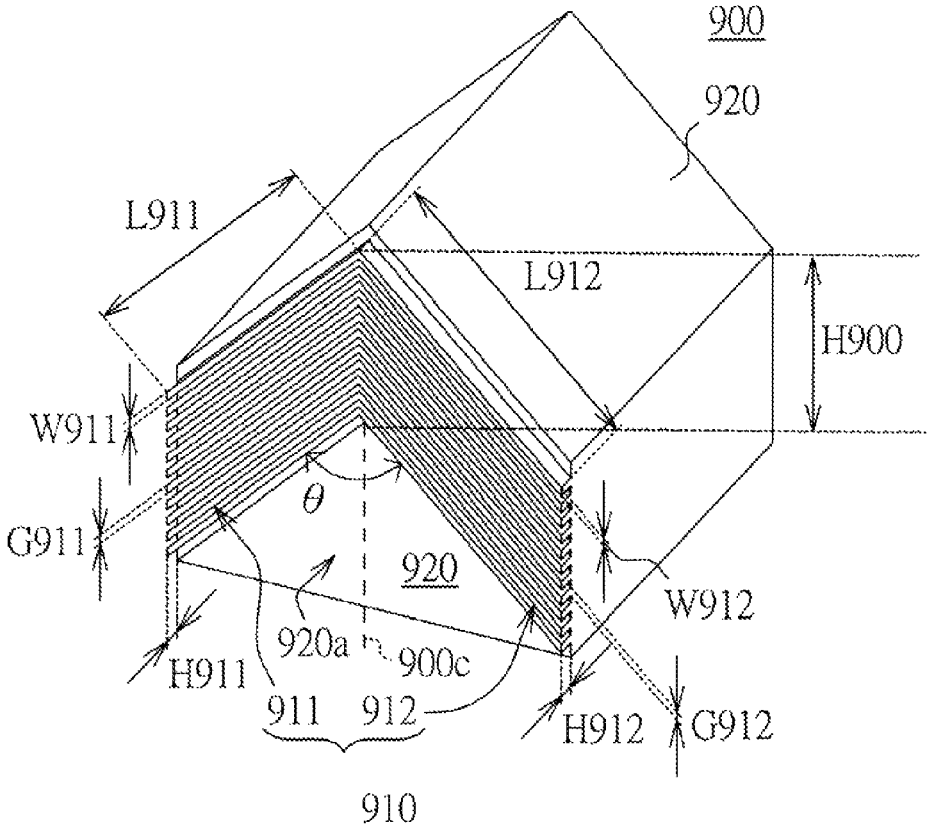
FIG. 3 is a schematic diagram of an embossing tool of FIG. 1.

FIG. 3 shows a schematic diagram of an embossing tool 900. The embossing tool 900 is used to emboss pattern structures on the roller 100. The embossing tool 900 includes an embossing end 910 and a body 920. The embossing end 910 includes a plurality of first micro-groove structures 911 and second micro-groove structures 912. The plurality of first micro-groove structures 911 and second micro-groove structures 912 are parallel structures. Furthermore, the plurality of first micro-groove structures 911 locates in one side with respect to a symmetry line 900*c*. The plurality of second micro-groove structures 912 locates in the other side with respect to the symmetry line 900*c*. With respect to the symmetry line 900*c*, each one of the plurality of first micro-groove structures 911 is symmetric to each one of the plurality of second micro-groove structures 912. One end of each of the first micro-groove structures 911 connects with one end of each of the second micro-groove structures 912 at the symmetry line 900*c*. In addition, an included angle between the symmetry line 900*c* and each one of the first micro-groove structures 911 is 45±8 degrees. Accordingly, the included angle between the symmetry line 900*c* and each one of the second micro-groove structures 912 is 45±8 degrees. A material hardness of the embossing tool 900 is greater than that of the roller 100. In one embodiment, the material of the embossing tool 900 is made of diamond.

As embodiments, each one of the first micro-groove structures 911 includes a length L911, a width W911 and a depth H911. Each two of the first micro-groove structures 911 form a gap G911 positioned. Accordingly, each one of the second micro-groove structures 912 includes a length L912, a width W912, a depth H912 and a gap G912 positioned. Wherein, each gap G912 includes an equal. Each included angle θ between the one of first micro-groove structures 911 and the one of second micro-groove structures 912 is substantially equal to one another. Furthermore, the length L911, the width W911, the depth H911 and the interval of the gap G911 are substantially equal to the length L912, the width W912, the depth H912 and the interval of the gap G912 respectively.

As shown in FIG. 3, the body 920 is a pentagon structure. The pentagon structure includes two pentagon-shape surfaces. The two pentagon-shape surfaces have a height H900 and dispose oppositely. The first micro-groove structures 911 and the second micro-groove structures 912 are disposed on one of the two pentagon-shape surfaces. In one embodiment, the first micro-groove structures 911 and the second micro-groove structures 912 are disposed in the one end near the roller 100. And a triangle-shape area 920*a* is disposed on the one of two pentagon-shape surfaces and adjacent to the embossing end 910. Wherein, the first micro-groove structures 911 and the second micro-groove structures 912 are not disposed on the triangle-shape area 920*a*. In addition, the embossing end 910 is a non-border structure.

Figure 1:
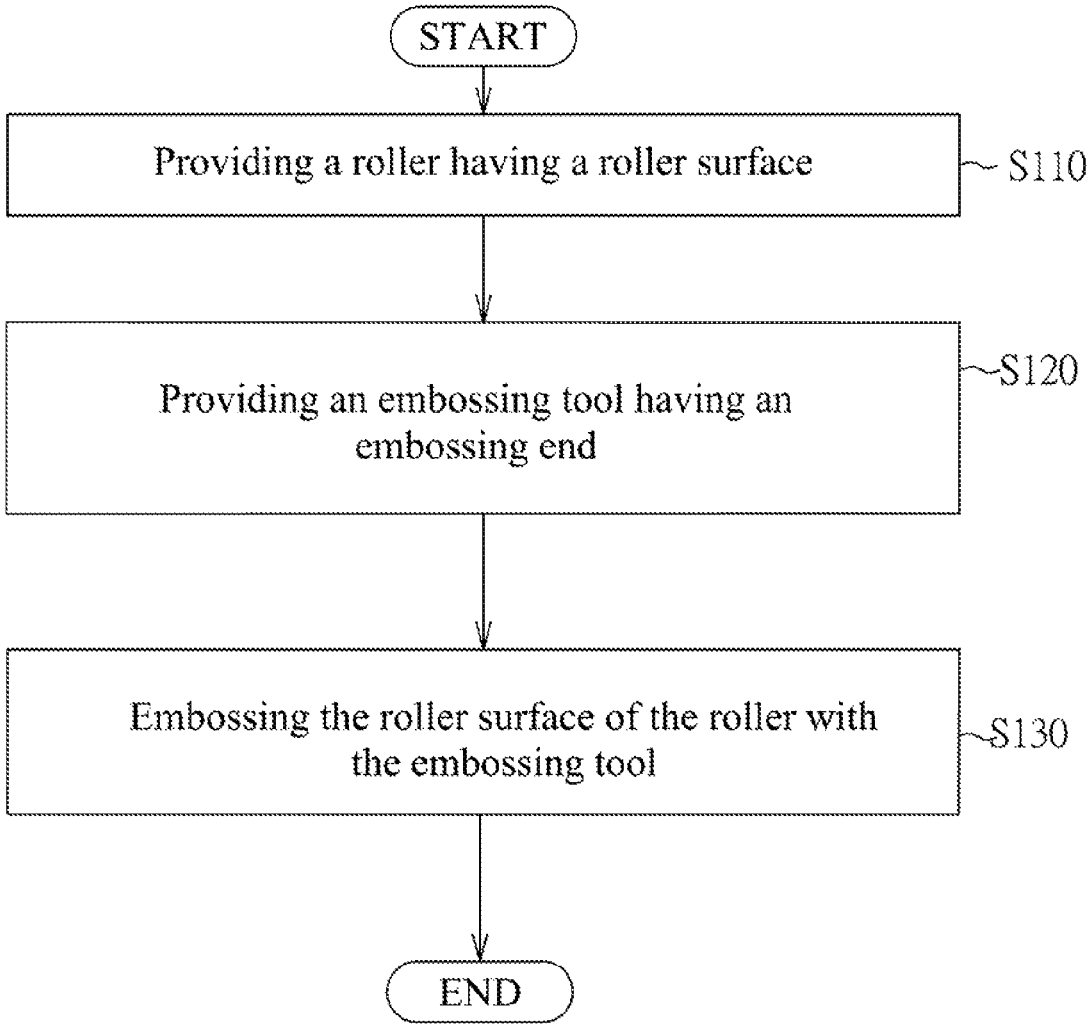
FIG. 1 is a flowchart of one embodiment of a manufacturing method of a roller for manufacturing a retarder film.

Referring now to FIG. 1, a flowchart of a manufacturing method of a roller 100 for manufacturing the retarder film 600 is shown. In step S110, the roller 100 having the roller surface 100*a* is provided.

In step S120, the embossing tool 900 having the embossing end 910 is provided.

Figure 4:
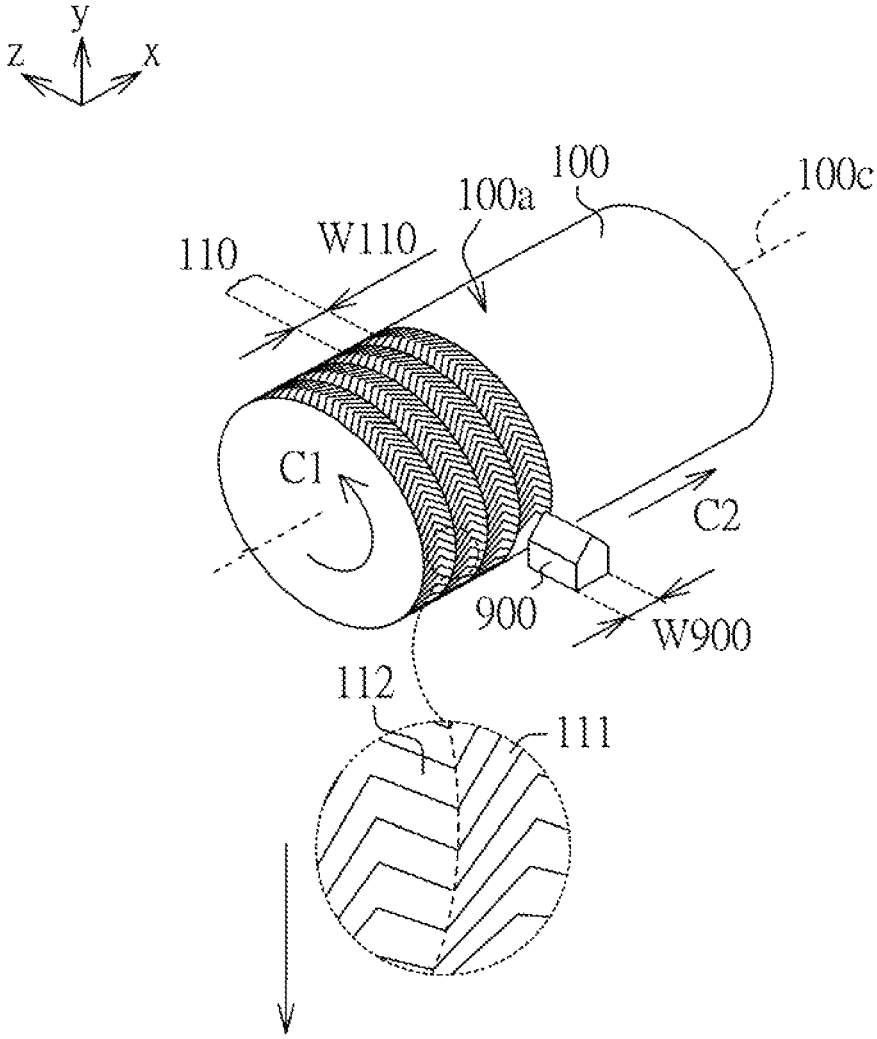
FIG. 4 is a schematic diagram of manufacturing the roller according to a first embodiment of the present disclosure.

In step S130, the embossing end 910 embosses the roller surface 100*a* of the roller 100. As shown in FIG. 4, the roller 100 turns along a rotation direction C1. The rotation direction C1 is parallel to the symmetry line 900*c* of the roller 100. After the repeatedly embossing, the embossing end 910 embosses a plurality of first embossing lines 111 and second embossing lines 112 disposed on the roller surface 100*a*. Wherein, the first micro-groove structures 911 emboss the plurality of first embossing lines 111 and the second micro-groove structures 912 emboss the second embossing lines 112.

Both the first embossing lines 111 and the second embossing lines 112 are parallel structures.

Figure 5:
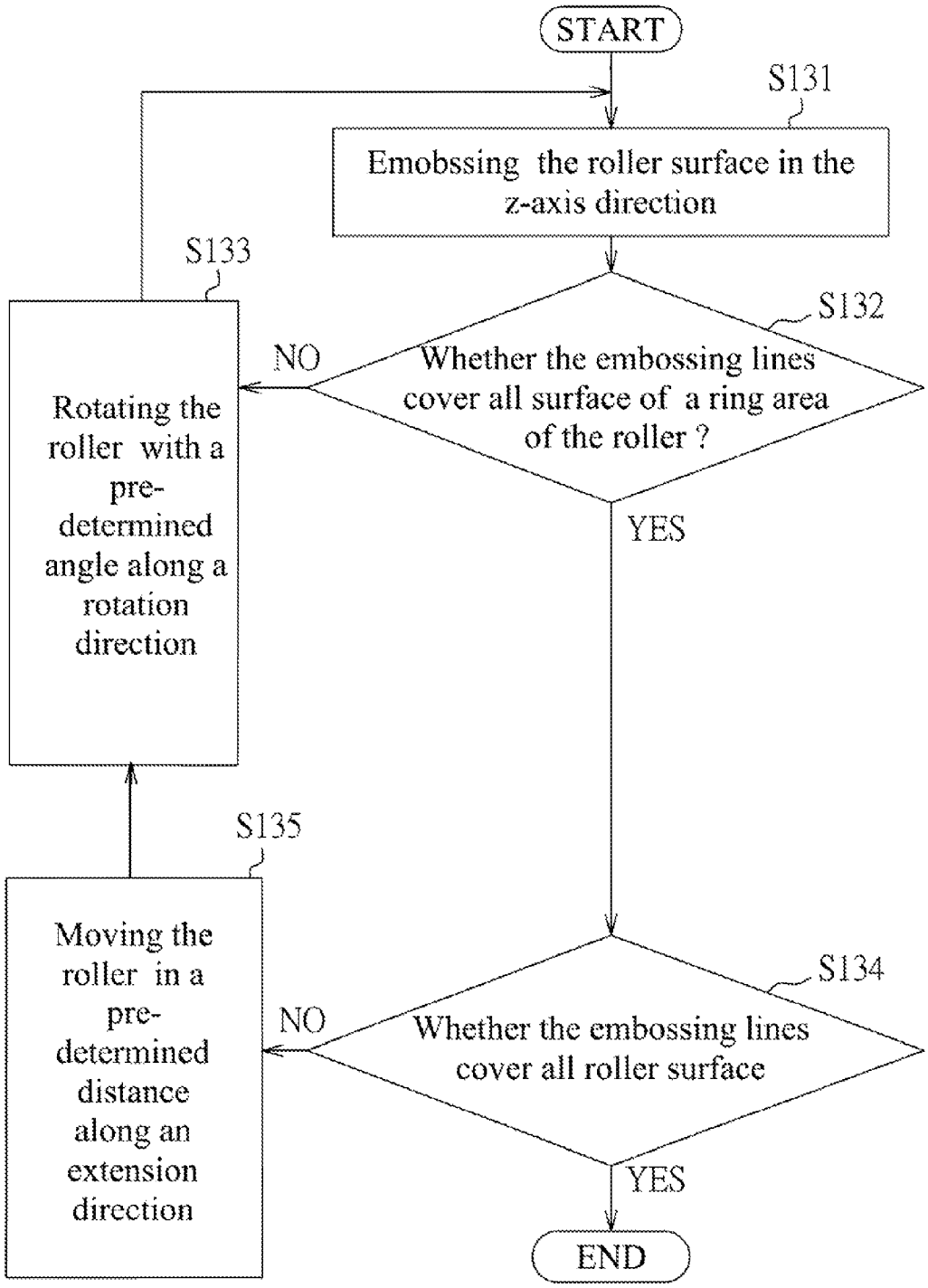
FIG. 5 is a flowchart of one embodiment of an embossing step of FIG. 4.

FIG. 4 shows a schematic diagram of manufacturing the roller 100 according to a first embodiment. In addition, FIG. 5 shows a flowchart of one embodiment of the embossing step S130 according to the first embodiment.

In step S131, the embossing tool 900 embosses the roller surface 100*a* in the z-axis direction. At the same time, the embossing tool 900 makes no movement in the x-axis and y-axis direction but the roller 100 turns along the rotation direction C1.

In step S132, determining whether the plurality of first embossing lines 111 and the second embossing lines 112 cover all surface of a ring area 110 of the roller surface 100*a*. Wherein, the first and second embossing lines 111, 112 cover all surface of the ring area upon detecting the roller 100 rotates one circle. The ring area 110 is a surface area of a ring structure of the roller surface 100*a*. In one embodiment, the determining process can be executed with an optical module to detect whether the first embossing lines 111 and the second embossing lines 112 cover all surface of the ring area 110. For example, the optical module is a camera module. If the plurality of first embossing lines 111 and the second embossing lines 112 cover all surface of the ring area 110, step S134 is implemented. Otherwise, step S133 is implemented.

In step S133, the roller 100 turns with a predetermined angle along the rotation direction C1 and returning to step S131. In one embodiment, the predetermined angle is calculated with a circumference of the roller 100 divided by the height H900 of the pentagon-shape surfaces.

In step S134, determining whether the plurality of first embossing lines 111 and the second embossing lines 112 cover all roller surface 100*a*. If the plurality of first embossing lines 111 and the second embossing lines 112 cover the all roller surface 100*a*, the embossing process goes to end. Otherwise, step S135 is implemented. In one embodiment, the determining process can be executed with the optical module to detect whether the first embossing lines 111 and the second embossing lines 112 cover the all roller surface 100*a*. For example, the optical module is a camera module.

In step S135, the embossing tool 900 is moved in a predetermined distance along an extending direction C2 of the roller 100. The extending direction C2 is paralleled to the rotation axis 100*c* of the roller 100. In one embodiment, the predetermined distance is a width W900 of the embossing tool 900. The width W900 is substantially equal to a width W110 of the ring area 110. The process returns to step S131 after step S135 is implemented. The manufacturing method provides both a manufacturing accuracy and a faster manufacturing speed of the roller 100. Accordingly, the manufacturing method also provides the manufacturing accuracy and the faster manufacturing speed of the retarder film 600.

FIG. 6 shows a schematic diagram of the first and a second embodiment of the retarder film 600 manufactured with the roller 100. During the embossing process, the roller 100 embosses a plurality of phase retardation structures 610 on a base substrate 601. In some embodiments, the base substrate 601 is the Polyethylene terephthalate (PET), polycarbonate (PC), triacetyl cellulose (TAC), Polymethylmethacrylate (PMMA) or cyclo-olefin polymer (COP). A thickness of the base substrate 601 is in the range of 30 microns to 300 microns.

The plurality of phase retardation structures 610 include a plurality of first stripe structures 611 and a plurality of second stripe structures 612. The plurality of first stripe structures 611 are embossed with the plurality of first embossing lines 111 of the roller 100. And the plurality of second stripe structures 612 are embossed with the plurality of second embossing lines 112 of the roller 100.

After the embossing process finished, a liquid crystal layer 620 is disposed on the phase retardation structures 610 to form the retardation film 600. The liquid crystal layer 620 disposed on the phase retardation structures 610 can generate different phase retardation effects in different areas of the retardation film 600.

Second Embodiment

Figure 7:
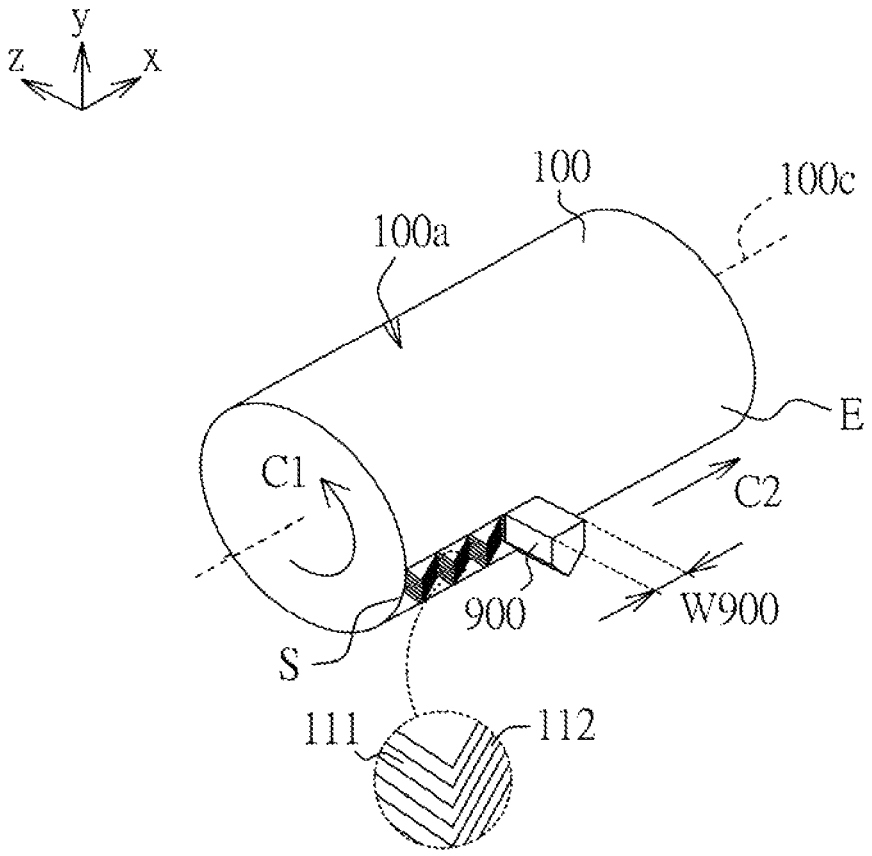
FIG. 7 is another schematic diagram of manufacturing the roller according to a second embodiment of the present disclosure.

FIG. 7 shows a schematic diagram of manufacturing the roller 100 according to the second embodiment. In the second embodiment, the flowchart of manufacturing method of the roller 100 is shown in the FIG. 1.

Except step S130 of the FIG. 1, other steps between the first and the second embodiments are the same in the FIG. 1.

Figure 8:
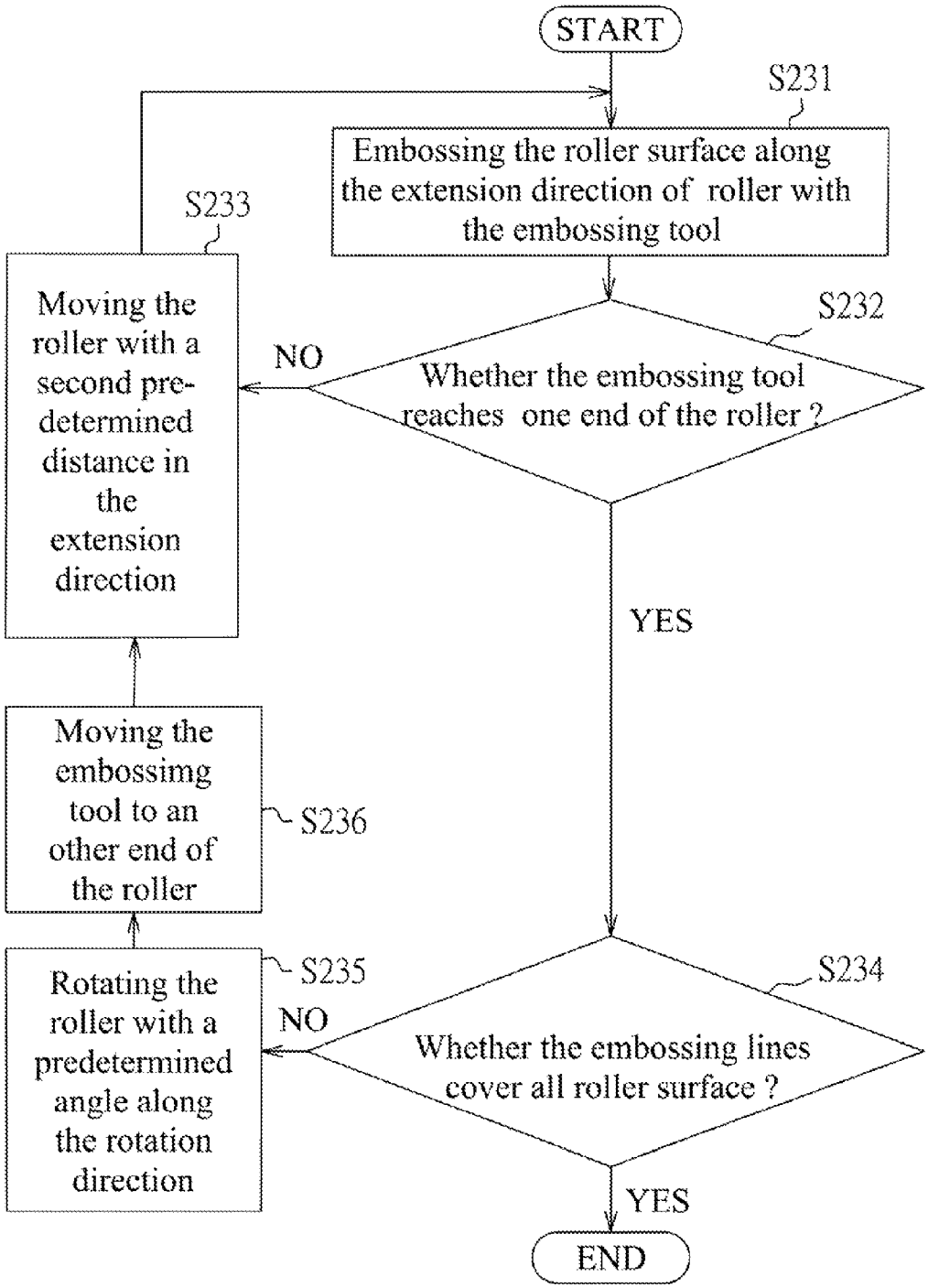
FIG. 8 is a flowchart of one embodiment of an embossing step of FIG. 7.

FIG. 8 shows a flowchart of an embossing step of the second embodiment. FIG. 8 shows the difference of step S130 in FIG. 1 between the first and the second embodiments.

In step S231, the embossing tool 900 embosses the roller surface 100*a* along the extending direction C2 of the roller 100.

In step S232, it is determined whether the embossing tool 900 reaches one end of the roller 100. If the embossing tool 900 reaches one end of the roller 100, step S234 is implemented. Otherwise, step S233 is implemented. In one embodiment, the determining process can be executed with an optical module to detect whether the embossing tool 900 reaches the one end of the roller 100. For example, the optical module is a camera module.

In step S233, the roller 100 moves with a second predetermined distance in the extending direction C2 of the roller 100 and returning to step S231. In one embodiment, the second predetermined distance is the width W900 of the pentagon-shape surfaces.

In step S234, determining whether the plurality of first embossing lines 111 and the second embossing lines 112 cover the all roller surface 100*a*. If the plurality of first embossing lines 111 and the second embossing lines 112 cover the all roller surface 100*a*, the embossing process ends. Otherwise, step S235 is implemented. In one embodiment, the determining process can be executed with an optical module to detect whether the first embossing lines 111 and the second embossing lines 112 cover the all roller surface 100*a*, such as a camera module. In other embodiments, the roller 100 stops to turn during steps S231, S232, S233, and S234.

In step S235, the roller 100 turns with the predetermined angle along the rotation direction C1. The rotation direction C1 is parallel to the symmetry line 900*c* of the roller 100.

In step S236, the embossing tool 900 moves to the other end of the roller 100.

The present patterned retarder film manufactured according to one embodiment of the present disclosure is utilized with at least one of functional optical films selected from a group consisting of hard-coating film, low reflective film, anti-reflective film and anti-glaring film on the surface of the base film opposed to the surface for forming the alignment layer in order to provide desired additional optical functionalities.

While the disclosure has been described by way of example and in terms of the preferred embodiment(s), it is to be understood that the disclosure is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A method for making a roller used for manufacturing a retarder film, comprising:

providing the roller having a roller surface;

providing an embossing tool having an embossing end; and embossing the roller surface repeatedly with the embossing tool;

wherein the embossing end has a plurality of first micro-groove structures and a plurality of second micro-groove structures; the first micro-groove structures and the second micro-groove structures are structures with parallel micro-grooves; the respective first micro-groove structures are symmetric to the respective second micro-groove structures with respect to a symmetry line, one end of each of the first micro-groove structures correspondingly connects with one end of each of the second micro-groove structures at the symmetry line; and a first included angle between the symmetry line and each first micro-groove structure and a second included angle between the symmetry line and each second micro-groove structure are 45±8 degrees.

2. The method of claim 1, wherein the symmetry line is substantially parallel to a tangential line extending from the surface of the roller in the direction of the rotation of the roller.

3. The method of claim 1, wherein micro-grooves of the first micro-groove structures and the second micro-groove structures are substantially the same in length.

4. The method of claim 1, wherein intervals between micro-grooves of the first micro-groove structures and intervals between micro-grooves of the second micro-groove structures are substantially the same.

5. The method of claim 1, wherein micro-grooves of the first micro-groove structures and the second micro-groove structures are substantially the same in width.

6. The method of claim 1, wherein micro-grooves of the first micro-groove structures and the second micro-groove structures are substantially the same in depth.

7. The method of claim 1, wherein the steps of embossing the roller surface comprises the step of:

turning the roller and embossing the roller surface with the embossing tool along the rotation direction repeatedly; and moving the embossing tool a predetermined distance along an extending direction of the roller upon the roller turning a circle.

8. The method of claim 7, the predetermined distance is a width of the embossing tool.

9. The method of claim 1, wherein the steps of embossing the roller surface comprises the step of:

embossing the roller surface with the embossing tool along the extending direction;

moving the embossing tool along the extending direction of the roller after the embossing step; and turning the roller with a predetermined angle upon the embossing tool reaching one end of the roller.

10. The method of claim 9, wherein the predetermined angle is calculated with a circumference of the roller divided by a height of the pentagon-shape surfaces.

11. The method of claim 1, wherein the roller is made of copper and the embossing tool is made of diamond.

12. The method of claim 1, wherein the embossing tool is a pentagon-shape.

* * * * *